United States Patent [19]

Damm et al.

[11] Patent Number: 4,915,159

[45] Date of Patent: Apr. 10, 1990

[54] METHOD AND APPARATUS FOR COMPACTING FOUNDRY MOLD MAKING MATERIAL ABOUT A FOUNDRY MOLD PATTERN

[75] Inventors: Norbert Damm, Karlsdorf-Neuthard; Ernst Schmitt, Malsch; Thomas Parr, Karlsruhe, all of Fed. Rep. of Germany

[73] Assignee: BMD Badische Maschinenfabrik Durlach GmbH, Karlsruhe, Fed. Rep. of Germany

[21] Appl. No.: 205,436

[22] Filed: Jun. 10, 1988

[30] Foreign Application Priority Data

Jun. 13, 1987 [DE] Fed. Rep. of Germany ..... 3719846
Nov. 27, 1987 [DE] Fed. Rep. of Germany ..... 3740185

[51] Int. Cl.[4] ..... B22C 15/08; B22C 15/28

[52] U.S. Cl. ..... 164/456; 164/7.1; 164/37; 164/38; 164/154; 164/160.1; 164/173; 164/195

[58] Field of Search ..... 164/7.1, 37, 38, 160.1, 164/172, 173, 169, 195, 456, 154

[56] References Cited

U.S. PATENT DOCUMENTS

| | | | |
|---|---|---|---|
| 2,959,828 | 11/1960 | Frankenstein | 164/173 |
| 3,293,703 | 12/1966 | Taccone | 164/195 X |
| 3,586,093 | 6/1971 | Young | 164/173 |
| 4,588,017 | 5/1986 | Damm et al. | 164/169 |
| 4,617,978 | 10/1986 | Damm | 164/37 X |
| 4,620,584 | 11/1986 | Witt | 164/160.1 |

FOREIGN PATENT DOCUMENTS

| | | | |
|---|---|---|---|
| 0172937 | 3/1986 | European Pat. Off. . | |
| 516911 | 1/1931 | Fed. Rep. of Germany . | |
| 1239065 | 4/1967 | Fed. Rep. of Germany . | |
| 1433977 | 10/1968 | Fed. Rep. of Germany . | |
| 2144387 | 4/1972 | Fed. Rep. of Germany . | |
| 2936173 | 4/1980 | Fed. Rep. of Germany . | |
| 3406466 | 8/1985 | Fed. Rep. of Germany . | |
| 749545 | 7/1980 | U.S.S.R. | 164/173 |

OTHER PUBLICATIONS

Giesserei-Praxis (Foundry Practice) 1965, vol. 21, pp. 440–442.

"Olehydraulik und pneumatik", (Oil Hydraulics and Pneumatics) vol. 10, 1966, No. 1, pp. 26–27.

*Primary Examiner*—Nicholas P. Godici
*Assistant Examiner*—J. Reed Batten, Jr.
*Attorney, Agent, or Firm*—Frishauf, Holtz, Goodman & Woodward

[57] ABSTRACT

To permit close matching of compaction pressure being applied to foundry mold making material, such as foundry sand, to the shape of a mold pattern (2) in a pattern box (3, 4), individual fluid pressure is applied to a plurality of press plungers (7) located on a pressure plate which is moved towards the sand in the mold box at a high rate of speed, the press plungers being biassed by fluid pressure to have a maximum difference (ΔH) in stroke of penetration depth of at least 30% of the height (H) of the mold box; individual valves (14) can apply compressed air to individual cylinders under control, for example, of a microprocessor; the valves can be located in a matrix arrangement (FIG. 3). The method and apparatus can be used in combination with explosion or pressure impulse compaction and fluidizing of the foundry sand.

40 Claims, 7 Drawing Sheets

13
6
12
VENT
17
220
CONTROL
UNIT
15
16
10
9
7
ΔH
H
3
2
1

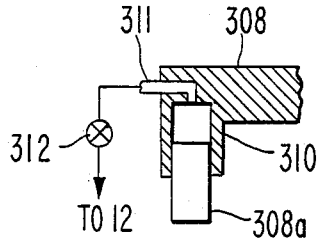
FIG. 3a
FIG. 3
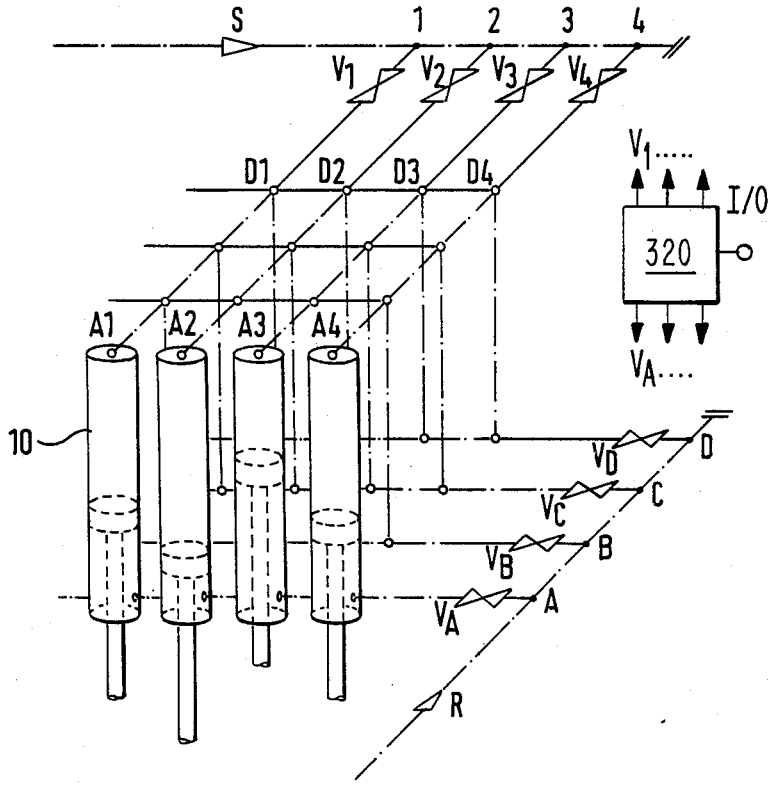

13
CONTROL UNIT
20
9
25
8
4
7
3

METHOD AND APPARATUS FOR COMPACTING FOUNDRY MOLD MAKING MATERIAL ABOUT A FOUNDRY MOLD PATTERN

The present invention relates to a method and apparatus to compact foundry making material about a molding pattern within a mold box, and more particularly to such an apparatus which has individual press plungers or stamping elements to compress and compact the foundry molding material about complex patterns and especially patterns which have widely different levels of profile surfaces.

DEFINITION

In the specification and claims that follow, the term "foundry mold making material" will be used, effectively interchangeably with the term "sand"; it is to be understood that, when "sand" is used, equivalent foundry mold making materials are also intended to be covered thereby and not merely "sand". Yet, since foundry sand is usually used, and the term is well understood and has historical significance, it will be used herein interchangeably and generically for any mold making material.

BACKGROUND

It is desirable to have at least approximately the same density or supporting capability of the molding sand within a mold box, surrounding the molding pattern. In actual practice, friction along the surfaces of the mold box and the surfaces of the molding pattern, substantial differences in level of surfaces of the molding pattern, or narrow and deep contours of the molding pattern lead to different densities, different compaction, and hence different support capabilities of the sand. For example, if the pattern has surfaces which vary widely in level, it may happen that sand over elevated surfaces is excessively compacted whereas, in narrow and deep contours of the pattern, as well as at the surfaces facing the mold box, regions will be left in which the sand is only slightly compacted and substantially less so than at the regions of high pattern surfaces.

In general, two stages of compaction are used when the contours of the pattern are complex. Compaction of the back of the sand can be obtained by using a pressure plate with a multiplicity of press plungers. The press plungers are intended to compensate, automatically, for differences in compaction due to the pattern shape during the compaction process. German Patent Disclosure Document DE-OS 29 36 173, Geiger, describes an apparatus for compaction of sand in which the sand is first pre-compacted by a pressure plate and then, in a second step, press plungers, movable through the pressure plate, carry out final compaction. The press plungers are moved towards the pattern by being retained within a chamber which is subjected to a common pressure source, such as hydraulic or pneumatic pressure fluid. The press plungers penetrate into the back of the sand, more or less deep.

European Patent Publication 01 72 937, Fuchigami et al, describes carrying out compaction by a presser plate having a plurality of press plungers or squeeze heads therein; subsequently, and with the mold box raised, a final compaction is obtained by pressing the entire assembly together.

Multiple press plunger presser plate are also known in which press plungers adjacent the circumference of the mold box are subjected to a higher pressure level than press plungers which are more centrally located, when the filled mold box is moved upwardly against the press plunger by a suitable lifting table or the like. This results in somewhat better matching of the press plungers to the contour of the pattern during the plunger stroke; no account is taken, however, of differences in shape of the pattern itself and differences and compaction or density of the sand will result, taken across the pattern. It is, thus, usually necessary to combine such a system with compaction by shaking or vibration.

THE INVENTION

It is an object to improve mold making technology, and more particularly methods and apparatus in which a plurality of press plungers are used which result in better and essentially uniform quality of compaction of the foundry mold making material even if the contours of the patterns show wide variations in levels and surface configuration, which is readily adaptable and can be carried out by simple and reliable apparatus.

Briefly, a plurality of press plungers are provided passing through a compaction plate; at least those plungers which are located in a central or inner region, with respect to the mold box, have individual fluid pressure applied thereto, in accordance with the contour or shape of the pattern. Thereafter, the pressure plate is utilized to additionally compact the mold making material, and is moved to about the upper edge of the mold box. The compaction steps, including the step of applying fluid pressure, is so carried out that at the end of the compaction step, there is between respective press plungers a difference ($\Delta H$) in the stroke or penetration between individual press plungers of at least 30%, and preferably at least 40% of the height ($\Delta H$) of the mold box.

The movement of some of the press plungers will not necessarily be a maximum, so that the difference between some of the press plungers and others will reach the 30% or preferably at least 40% stroke difference level; some of the plungers, however, at least should exhibit this difference stroke.

It has been found, entirely surprisingly, that individual control of pressure of the respective plungers, which is continued to the end of the compaction step, and thus results in forced differences in stroke between the respective press plungers, permits compaction even within narrow and deep pockets of the mold pattern, as well as high compaction values in the side or marginal regions free from any mold pattern. It appears that the reason for this surprising increased compaction level is due to the fact that, in accordance with a feature of the invention, the final compaction position of the respective press plungers is reached over the entire contour of the pattern essentially at the same instant of time. Relative movement of sand within the region of the pattern, resulting in fissures of already compacted sand, is effectively eliminated.

It has been found that the difference in stroke between the respective plungers is important. These differences in stroke which, in accordance with the prior art were comparatively small and only in the order of 10% to 20%, are extended substantially in accordance with the method and apparatus of the present invention, to be differences of at least 30%, preferably over 40%, and reaching in some instances, 50% to 80% of height of the mold box. It has been found, surprisingly, that the resulting substantial depressions in the back surface of the mold sand did not have a negative effect on compaction but, rather, a highly positive effect.

The method has been found to yield particularly good results when the sum of the cross-sectional areas of the press plungers is between 20% to 70% of the surface of the mold box, a range of between 20% to 50% being preferred. In accordance with a particularly advantageous feature, the central region of the mold box should have more specific press plunger surface associated therewith than the marginal or edge regions.

High speed during the compaction process and high stroke speeds of the press plates and the plungers themselves are advantageous. Press plunger speeds which are between about 0.2 to 0.7 m/s, as known, are substantially increased in accordance with a feature of the invention. It is desirable, in the system and method of the present invention, to use plunger stroke speeds of over 2.0 m/s, and particularly 3 to 10 m/s. Values of from between 4 to 8 m/s are particularly desirable. It appears that, with such high stroke speeds of the plungers, dynamic effects are obtained which are similar to the effects within the sand of gas impulse compaction. The particles of the mold making material are accelerated to such an extent that, when they meet the surfaces of the pattern or of the pattern holder plate, the impacting impulse causes increased density above that which is obtainable by slow mechanical pressure. The same, of course, is true for particles of the mold making material within the pressure plate, if the pressure plate is moved against the pattern with the same or similar speeds as that of the plungers.

Transferring kinetic energy of the press plungers and of the pressure plate to the mold making material without damping may result in an undesirable excessive compaction or application of pressure on surfaces of the pattern which are elevated with respect to the pattern holding plate. Such excess pressure can be avoided, in accordance with a feature of the invention, by applying the kinetic energy only in those regions of the pattern which are not above high portions of the pattern but, rather, are only over low zones, or in zones free from the pattern, such as the edge zone of the mold box. Preferably, the pressure plate is extended at its edge in the region adjacent the outer press plungers with projections at the lower side. Such projections at the lower side can be a circumferential strip interrupted, for example, only by outer press plungers. The edge region of the pressure plate, then, forms a damping zone for the pressure plate and the individual plungers coupled thereto; additionally, the edge or edge zone provides for the supplemental or additional compaction.

Application of pressure to the respective press plungers is preferably carried out by discretely commanded pressure fluid. Thus, rather than applying to the press plunger a pressure which is equalized, each plunger will have a predetermined support pressure applied thereto. This can be obtained, for example, by removing the plungers, prior to compaction, entirely from the pressure plate and then, and in dependence on the shape of the pattern and the level of the pattern above the pressure plates, applying respectively different counter pressure, for example pneumatic pressure, against the plungers. The pressure plate, together with the relatively shifted press plungers is then pressed against the mold making material.

In accordance with another feature of the invention, and alternatively, the press plungers can be set initially in accordance with the approximate profile of the pattern to different levels and then, and typically and preferably hydraulically, retained in position and supported in the relatively adjusted position. Upon subsequent compaction, the level of the plungers will be essentially retained.

The mechanical compaction method described can readily be combined with compaction by a gas pressure pulse. The gas pressure pulse can be obtained, as well known, by admitting compressed air, or by explosion of an ignitable gas mixture.

The gas pressure pulse can be applied before and/or during mechanical pressure. In dependence on the results to be obtained, the pressure level and the course of the pressure, with respect to time, can be as high as in pure impulse compaction, or less than impulse compaction. During compaction, gas can also be vented from the mold box, particularly through the model support plate; active suction can be applied.

Multi-stage compaction, for example when using compressed gas or an ignitable gas mixture, has the advantage that the compressed gas which passed through the sand causes fluidizing on the one hand and, additionally, pre-compression of the sand on the other. Both effects together improve the compaction characteristics of the mold form.

In accordance with a feature of the invention, an apparatus to carry out the method utilizes individual fluid pressure supply lines at least for those press plungers which are in a central zone or within a region inwardly of the outermost press plungers. Individual valves are provided for connection to a pressure source. The individual press plungers can be pneumatically biassed to a predetermined support or bias pressure which can be selected in accordance with the contour of the pattern to be molded; alternatively, the press plungers can be set by hydraulic means in accordance with the specific pattern shape or contour to different levels.

In accordance with a feature of the invention, and for differential individual pressurization of the respective press plunger for the respectively selected stroke positions, pressure cylinders to which the press plungers are coupled can be connected over suitable switching valves to a common pressure source. The number of valves can be substantially reduced if the valve arrangement is in form of a matrix, in which valves are connected to common supply lines of plungers arranged in rows and columns. The respective lines are connected to the valves over supply and drain lines, respectively, and a micro processor of any suitable and well known construction which provides switching output signals can then control the respective row and column lines to provide just the right amount of pressurized fluid or pressure levels to the respective press plungers in accordance with the selected stroke position of the respective plungers.

Multi-step compression by utilizing additional pressure gas, either obtained in the form of compressed air or upon ignition of an explosive mixture, can be easily combined with the individual plunger-adjustment mechanical compression by locating a pressure head within a pressure chamber which engages tightly against the filling frame of the mold box. In such a construction, the pressure head preferably includes a valve disk structure with a corresponding valve seat coupled to a pressure container, in order to, respectively, open or close a pressure source providing the gas pressure to the region in communication with the mold box. The gas pulse should preferably be directed to the molding sand without incurring substantial losses; it is desirable to permit the compressed gas to pass not only between the pressure plate or pressure head and the filling frame, but also via suitable openings in the pressure head and therethrough against the sand.

In accordance with another feature of the invention, the pressure head itself can be constructed to form a compressed gas chamber, and coupled to a pressure source. If so made, the press head should tightly engage against the filling frame, for example by forming a sliding seal between the press head and the filling frame.

Drawings, showing illustrative embodiments:

FIG. 3 is a connection diagram for connecting fluid cylinders in a matrix connection;

Figure 1:
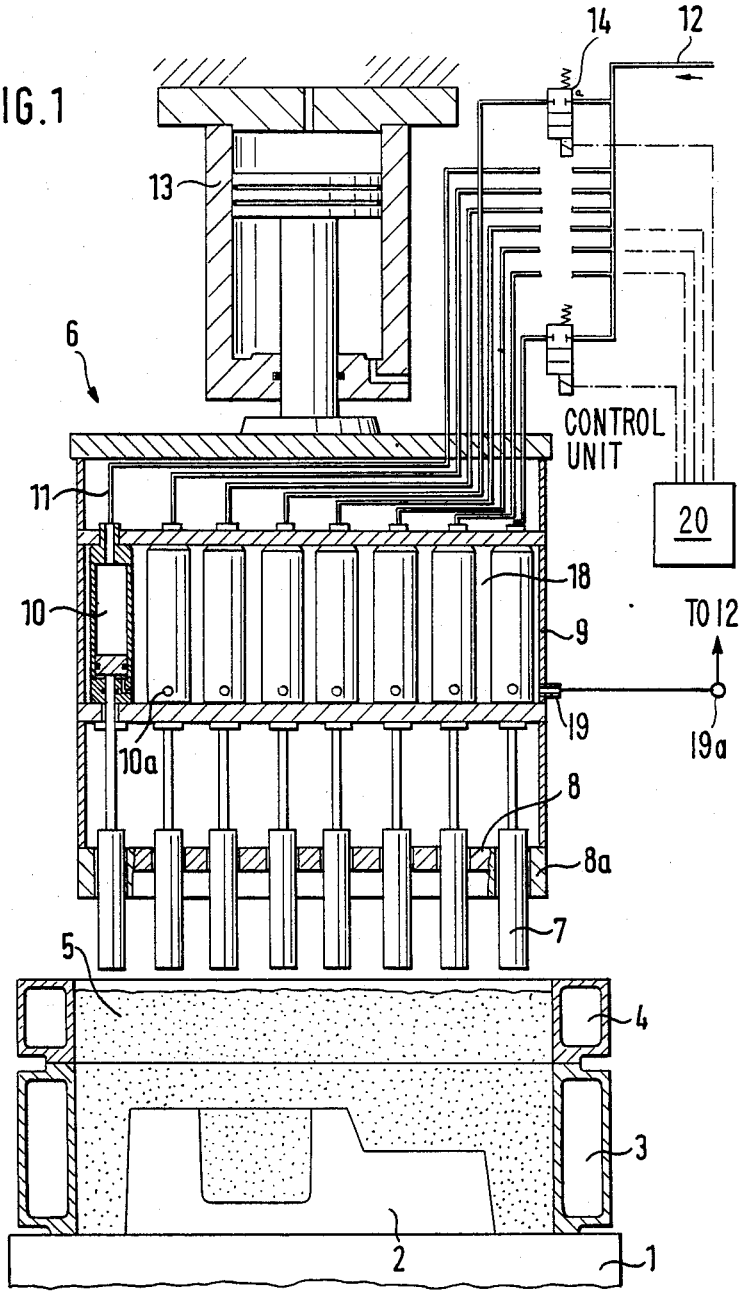
FIG. 1 is a highly schematic side view, partly in section, of a mold making machine at the beginning of compaction.
Figure 4:
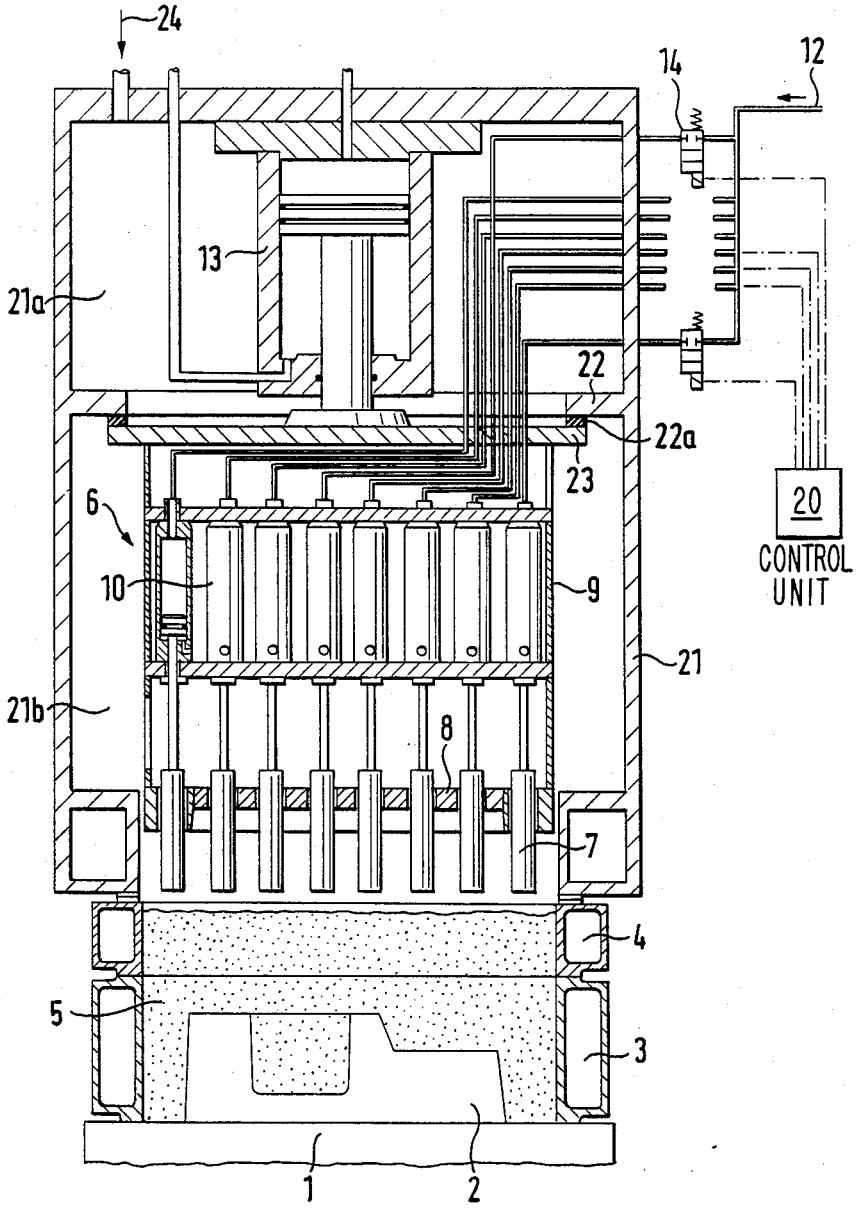
Figure 5:
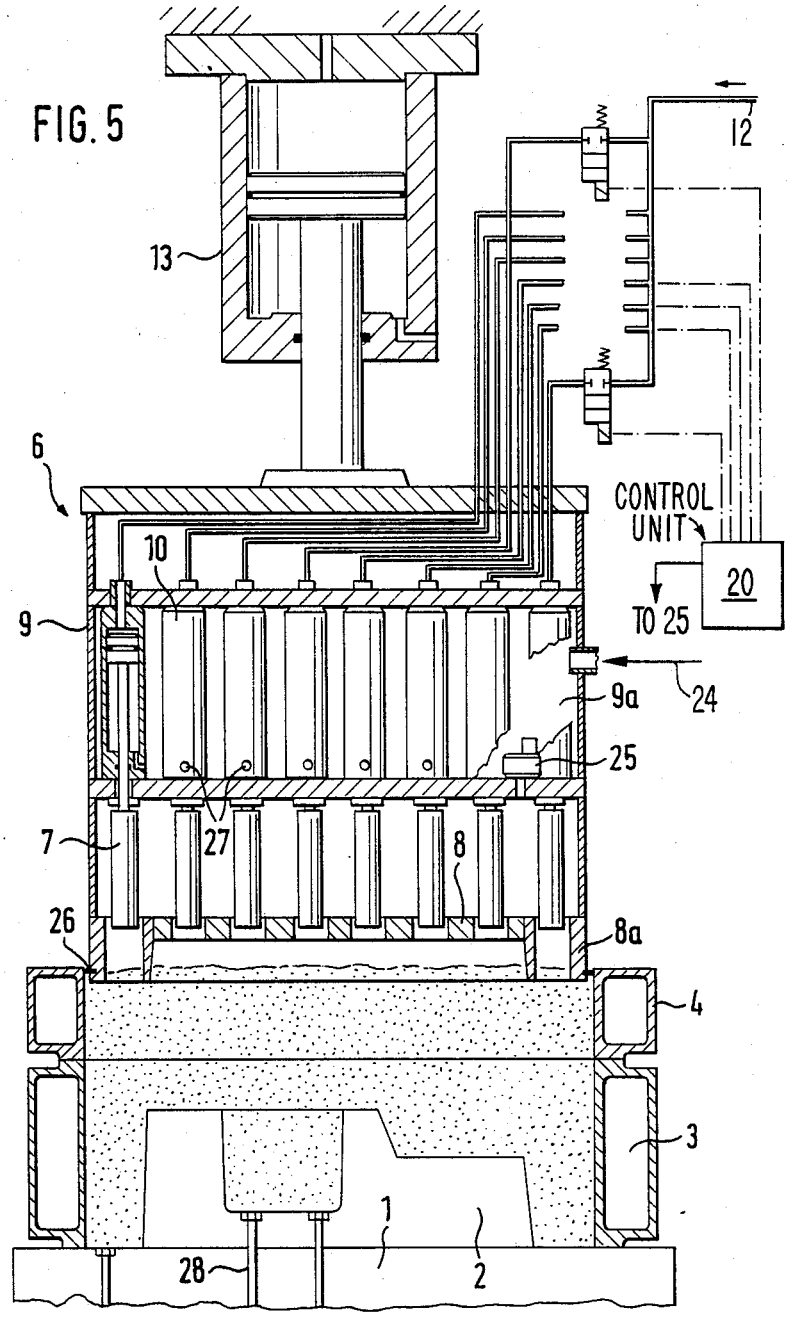
Figure 6:
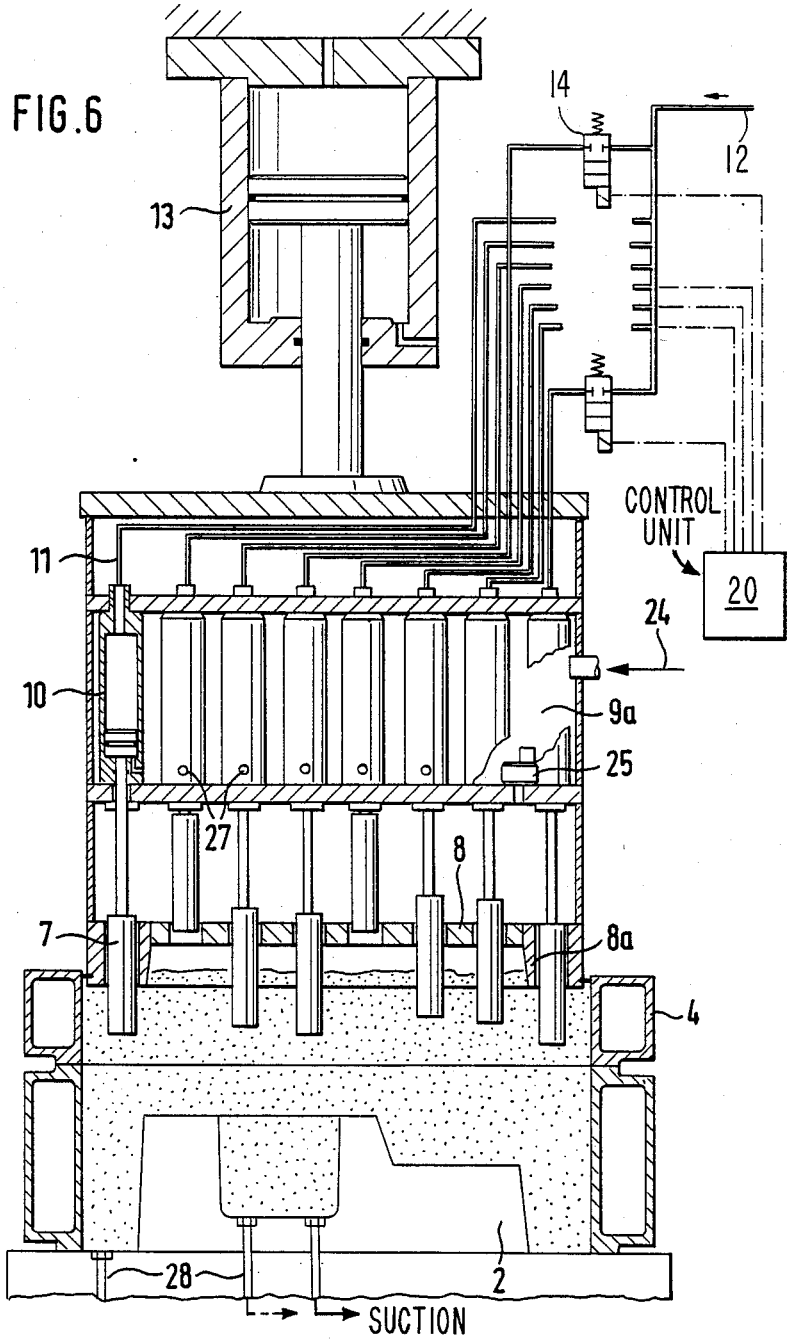
Figure 7:
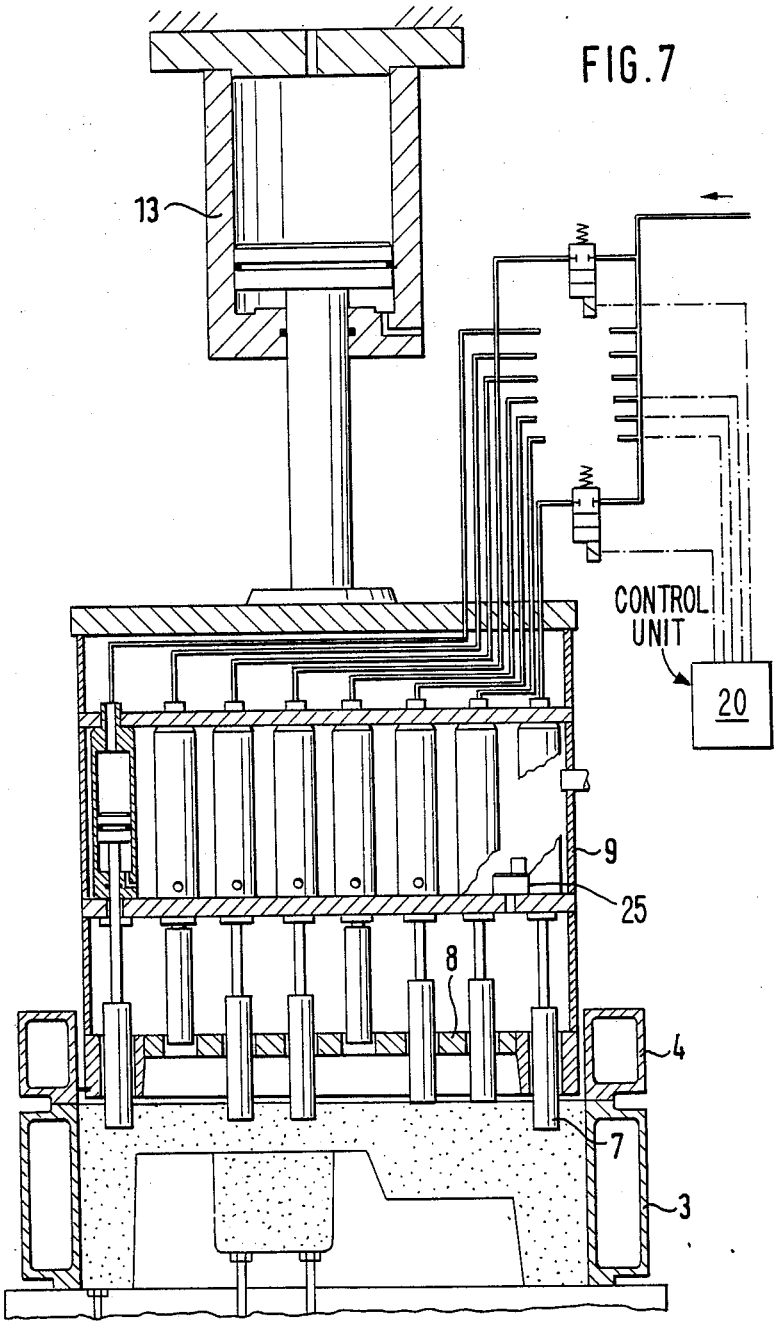

FIG. 3*a* is a fragmentary view of a part of the mold frame and pressure plate showing an adjustable mold frame end ring;

FIG. 4 is a view similar to FIG. 1 and showing an apparatus for two-step compaction, at the beginning of compaction;

FIG. 5 is a vertical view through the apparatus of FIG. 4, omitting non-essential elements or elements previously described, at the beginning of compaction and showing another embodiment;

FIG. 6 is a view corresponding to FIG. 5 in an intermediate stage of compaction; and FIG. 7 is a view similar to FIG. 5 at the end of compaction.

DETAILED DESCRIPTION

A model or pattern support plate has the pattern 2 placed thereon. The pattern support plate and the pattern are retained within a mold box 3. A fill frame 4 is placed on the mold box. The mold making material, or sand, as defined, is loosely poured into the mold box through the fill frame 4.

A compacting unit 6 is located above the fill frame 4. The compacting unit 6 is a compression head, which carries a plurality of press plungers 7. The individual plungers 7 are distributed relatively uniformly over the cross-sectional area of the mold box 3. Preferably, they are cylindrical elements with a circular cross section. They are spaced from each other by approximately the diameter of the cylindrical elements. They pass through a horizontal pressure plate 8 which forms the lower end of a box-like compaction head 9. The lower cross section of the compaction head 9 is so dimensioned that it fits within the fill frame 4. The outer edge of the pressure plate 8 is formed by downwardly projecting strips or ridges 8*a* which, simultaneously, form downwardly extended guide bushings or guide surfaces for the outermost located press plungers 7.

In accordance with a feature of the invention, each one of the plungers 7 has associated therewith a compressed fluid cylinder 10, which is individually connected over a respective connecting line 11 with a pressure source 12.

A lifting or raising table, for example hydraulically operated, is provided, not shown in the drawing, in order to raise the mold box 3 against the compacting head 9. Alternatively, and in a preferred form, the compacting head 9 can be engaged into the mold box 3 or, rather, and initially, the fill frame 4, by a hydraulic cylinder 13; the mold box 3 with the pattern 2 therein can then remain stationary on a table or other similar support.

In accordance with a feature of the invention, the individual fluid pressure cylinders 10 are biassed by discretely selected pressure levels, for example by pneumatic pressure. The discrete pressure levels for biassing of the cylinders 10 is determined by the contour of the pattern 2. For example, and with reference to FIG. 1, the press plungers which are at the outer margin and are located over the regions which do not have any portion of the pattern therein are subjected to a pressure of 4 bar; the adjacent press plungers have about 1 bar pressure applied. The press plungers which are located above the recess in the center section of the pattern have about 3 bar compressed air applied thereto.

Individual pressure rise of the respective cylinder is obtained by electrically controlled valves 14, connected in the respective pressure lines 11, and controlled by a programming source 20 in accordance with a pressure pattern which will be determined by the shape of the mold pattern 2.

OPERATION

The hydraulic cylinder 13 will receive compressed pressure fluid, for example hydraulic oil, to move the entire compaction head 9 downwardly. It is accelerated to reach a speed of about 7 m/s. Upon downward movement, the respective press plungers 7 will engage into the sand at the upper level or back side thereof. They engage in advance of the subsequently following pressure plate 8. The spacing between the plungers and the high engagement speed insures that, at the end of the compaction process, the difference $\Delta H$ (see FIG. 2) of at least 30% of the height H of the mold box 3 in maximum deviation between the minimum depth of a plunger and the maximum depth of another plunger will obtain.

The space between the respective press plungers 7 is compacted by the pressure plate 8 which, at the compression stroke, follows and catches up with the press plungers 7.

Figure 2:
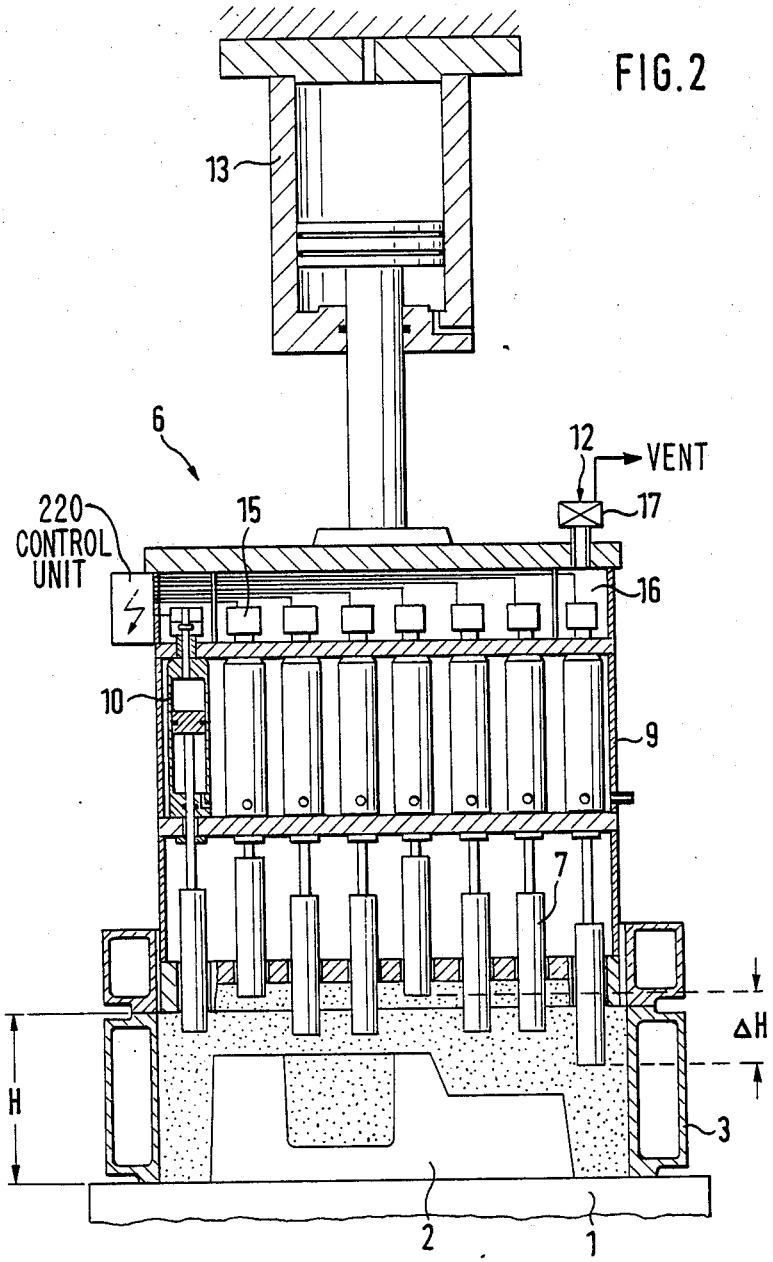
FIG. 2 is a view similar to FIG. 1, and omitting some elements not necessary for an understanding of the operation, of the apparatus of FIG. 1 at the end of compaction.

It has been found that a mold form made, for example, from a pattern similar to that shown in FIGS. 1 and 2, has a highly uniform strength of from about 18 to 20 $N/cm_2$ in spite of the steeply dropping off outer walls of the pattern and the deep depression in the center thereof.

After the compression stroke, the hydraulic cylinder 13 is subjected to oil pressure in the opposite direction, as well known, and the compacting head 9 is pulled off or out of the mold box 3 and the fill frame 4, respectively. The over pressure remaining in the cylinders 10 automatically brings back the press plungers 7 into the position shown in FIG. 1.

Any leakage from the cylinders !0 can be readily compensated by monitoring the pressure in the cylinders 10 and, automatically, resetting the pressure to the desired level; such monitoring and pressure supervisory systems, by and themselves, are well known and any suitable commercial arrangement may be used.

To prevent a press plunger from engaging a downgate or down-sprue, or fill funnel, it is desirable to leave the plunger which is immediately above the filling position in its retracted position. The fill position for the casting material is dependent on the shape of the mold pattern and changes. Thus, the respective press plunger must be retracted. This can be easily obtained in accordance with the present invention by applying openings 10*a* at the bottom of all the cylinders 10 and connecting the openings 10*a* to a common pressure chamber 18 within the compaction head 9 which, in turn, is connected through a duct 19 with a pneumatic pressure source, for example through a suitable valve or other connection 19*a* from the pressure source 12. This provides for elastic upwardly biassed pneumatic force being applied to all the press plungers biassing them to an upward position. Those press plungers which are above the casting inlet position will remain in the upper position; the other plungers are, respectively, biassed by a suitable compressed air biassing force as controlled by the respective valves 14 in the respective lines 11, under command of the control or command unit 20.

FIG. 2, apart from showing the general apparatus of FIG. 1 in a different position, also shows an alternative regarding the pressure supply of compressed fluid to the cylinders 10. Each one of the cylinders 10 is connected to an individual electrically operated inlet valve 15. All these valves are pressurized by being connected to a common pressure manifold or plenum 16. The plenum 16 is connected through an inlet - outlet and cut-off valve 17 to the pressure source 12 or, respectively, to the atmosphere for venting the chamber !6.

The selection of the pressure applied to the respective cylinders 10 with the desired pneumatic pressure is under command of an electronic command unit 20 (FIG. 1) or 220 (FIG. 2), respectively. The command unit 20 controls respective operation of the valves 14; the command unit 220 (FIG. 2) controls closing those valves 15 as pressure in plenum !6 increases, whose cylinders 10 have reached the desired pressure level. The pressure source 12 provides pressure at an increasing level, up to the desired maximum over-pressure.

The apparatus illustrated in FIGS. 1 and 2 is particularly suitable for use with compressed gas as the pressure fluid. The system can be used, however, equally with hydraulic pressure fluid to control the cylinders such that the press Plungers 7 are set already prior to compaction to different height levels and maintained at those levels in more or less fixed, non-varying position.

FIG. 3 illustrates a hydraulic control unit. To save valves, the respective cylinders are arranged in a two-dimensional matrix which has a field subdivided into columns and rows. For example, the cylinders 10 are located in columns 1, 2, 3, 4.... and, further, in respective rows A, B, C, D. The cylinders are serially connected into hydraulic lines. The serially connected cylinder connections of the columns are located at the upper end of the cylinder; in cross-bar connection, and at right-angle cross-over, the row cylinder connections are coupled to the lower ends of the cylinders. Each column S and each row R is hydraulically controlled by a respective ON/OFF valve $V_1$, $V_2$ and $V_A$, $V_B$... . Thus for S x R cylinders only S +R valves are necessary. In the construction of FIG. 1 with eight cylinders in a row and seven rows behind each other, that is, for 56 cylinders, only 7+8=15 individual valves are necessary.

OPERATION

To adjust the stroke or projection of a cylinder D3, only the two valves $V_D$ and $V_3$ are opened. Thus, compressed hydraulic fluid may flow over line S to drop the piston into a lower position. All other pistons in the row and all other cylinders in the column will remain blocked since one of the two valves controlling hydraulic fluid to the respective cylinders and rows has remained closed.

The system of FIG. 3 is particularly adapted for control with a programmable microprocessor 320, which receives input information from a terminal I/0. It is readily possible to program a microprocessor, using well known coding, to introduce a control program into the microprocessor representative of the three-dimensional height distribution along the matrix plane defined by the respective positions of the press plungers. It is easily possible to change the positions of the respective press plungers upon change of the pattern in the mold box in accordance with the profile of the pattern along respective rows and columns thereof.

Change of the position of the stroke of the respective press plunger can be carried out analogous to the profile of the pattern; it is desirable, however, to change the specific position of the press plungers in predetermined steps, that is, to control the actual position of the press plungers in predetermined individual steps. This, of course, prevents precise matching of the position of the press plungers to the profile of the model or pattern, and to provide, for example, an infinite number of plunger positions; in actual practice, however, steps of for example between 2 to 3 centimeters per plunger position are sufficiently close to achieve the desired effect.

For some arrangements, it is desirable to so construct the pressure plate 8 that its lower edge is formed with a continuous projection or rim 8*a* (FIG. 1); in other arrangements, however, and as shown in FIG. 3*a*, the presser plate 308 may have a plurality of projections which are individually adjustable. Thus, the pressure plate 308 is formed with cylinder-like extensions in which individual projection elements 308*a* are retained in any suitable manner, to be projected for example by pneumatic pressure from source 12 through a valve 3!2, and connected to a chamber 310 through a connecting duct 3!!. Individual projecting elements can be placed along the rim. This permits the use of pressure plates which can be used with different frames 4 by merely changing the projection distance of the projection 308*a*, or of the projection elements 308*a*, with respect to the plate 308, to match optimally to different sizes of patterns or contours of patterns. The projecting distance of the elements 308*a* may have a width, that is, a diametrical dimension of from between 5 to 10 cm, and a height of from between about 5 to 13 cm. Utilizing, for example, elements 308*a* of an intermediate length and projecting the elements by pneumatic pressure applied to the chamber 310, or to not projecting them, for example retraction under spring pressure, permits easy matching to respective frames and/or sizes and shapes of patterns to be reproduced.

The system and apparatus of the present invention lends itself well to combination with a gas blast acting on the sand. Such gas blasts, in dependence on the intensity thereof, cause fluidizing of the sand. It can be applied, preferably, simultaneously with pre-compression of the sand. The combination of mechanical pressure, as well as application of compressed air, or a blast obtained by explosion of an explosive mixture, is particularly desirable, in which the explosive blast can be applied before and/or during the application of mechanical pressure. Besides fluidizing, pre-compression can be obtained or, preferably, simultaneous application of a gas blast or pulse and mechanical pressure is applied against the molding sand.

FIG. 4 illustrates an embodiment of the invention in which the entire pressure head 6 together with the compaction head 9 and the pressure cylinder 13 are retained in a pressure vessel 21. The pressure vessel 21 has a valve 22 which, with the interposition of a seal 22*a*, cooperates with a head plate 23 of the compaction head 9. Head plate 23 forms a valve disk. The pressure vessel 21 is subdivided by the plate 23 into a closed upper chamber 21*a*, which is coupled to a pressure source 24; and to a lower chamber 21*b* which is coupled in an air-tight connection to the mold space defined by the mold box 3 and the fill frame 4.

OPERATION OF THE SYSTEM OF FIG. 4

The chamber 2!a is first filled with a compressed gas, for example and preferably compressed air. The head plate 23 of the compaction head 9 seals the chamber 21*a* over respective sealing surfaces 22*a*. Thereafter, hydraulic cylinder 13 is controlled to move the compaction head 9 downwardly, thereby opening chamber 21*b* to chamber 21*a*, and compressed gas within the chamber 21*a* flows downwardly, simultaneously with downward movement of the compaction head 9. It travels along the outer gap between the compaction head and the pressure vessel 21, as well as through gaps between the respective press plungers 7 and the pressure plate 8 to the still loose sand 5. This fluidizes the sand 5 and as the press plungers 7 engage within the sand 5, first a positive effect of decrease in friction is obtained and, thereafter, the compressed gas passing through the sand causes pre-compaction, as known. Final compaction is carried out by the then deeply penetrating press plungers 7 and, finally, by the pressure plate 8.

The individual press plungers 7 can be washed or surrounded by compressed gas; if it is not necessary to surround the individual press plungers 7 within the compaction head 9, it is of course also possible to introduce the compressed gas outside of the compaction head 9 to the space in which the mold form or pattern 2 is retained. It is equally possible to introduce the compressed gas over valves, not specifically shown, located laterally of the chamber 21*b* into the Pressure vessel 21, and above the fill frame 4.

FIGS. 5 to 7 illustrate a different embodiment of the invention, in which, again, the effects of the pressure plate 8, the individual press plungers 7, and gas compression are combined in a combination compaction process. Differing from the embodiment of FIG. 4, the compaction structure 6, that is, the compaction head 9, is formed, itself, as a pressure vessel. The compaction head 9 defines a chamber 9*a* which can be pressurized by a compressed gas connection 24. A plurality of valves 25, of which only one is shown in the drawings, can open communication between the chamber 9*a* and the head space beneath chamber 9*a*. The pressure head 9 is formed with sealing lips 26 on the outer edges of the rims 8*a* connected to the press or compaction plate 8, in order to provide sealing of the head 9 against the fill frame 4.

Chamber 9*a* is connected via connections 27 to the lower side of all the pressure cylinders 10, so that the compressed gas pulse is used not only for application against the molding sand but, also, to raise the press plungers 7. In the embodiment shown, the cylinders 10 are located directly within the chamber 9*a*. The connections 27, thus, may be merely cross bores located at the lower ends of the cylinders 10.

OPERATION, WITH REFERENCE TO FIGS. 5, 6 AND 7

FIG. 5 shows the beginning of the compaction process. The compaction head 9 has been introduced into the fill frame sufficiently to fit the sealing lips 26 against the frame 4. The pressure cylinders 10 are not pressurized above. The chamber 9*a* receives compressed gas from an external compressed gas source 25, to place the chamber 9*a* under pressure. This excess pressure is transmitted through the connections, for example bores 27, to the lower region of the cylinders 10 and retains the respective pistons in the cylinders, and hence the press plungers 7 in their upper or raised position.

FIG. 6 illustrates a subsequent step in the compaction cycle: The respective cylinders 10 are pressurized at their upper side by pressure from source 12 coupled through the respective valves 14 through lines !1, under control of the control unit 20. The pressures applied to the upper sides of the cylinders 10 are discretely controlled. Preferably, the source 12 provides gas pressure, for example compressed air. This presses the respective pistons and hence the press plungers 7 into the position determined by the shape of the pattern 2 within the mold box 3, so that the respective press plungers 7 penetrate with different depths into the sand.

At the same time, valves 25 are opened in the chamber 9*a*. This permits the gas, under pressure, from the chamber 9*a* to flow into the lower portion of the compaction head 9, washing around and surrounding the press plungers 7, for fluidizing the sand, and facilitating penetration of the plungers 7 into the surface of the foundry molding material or foundry sand. Additionally, they cause some pre-compaction of the sand.

As an alternative, and within the scope of the invention, fluidizing and pre-compaction could be triggered only after the press plungers 7 already have reached the position shown in FIG. 6, and corresponding to the contour of the pattern to be molded.

Vent lines, with valves (not shown), can be located at positions either in the pattern 2 or in the pattern support plate, to permit compressed air applied from source 24 and through valves 25 to be vented; additional suction could be applied to one or all of the vent lines and valves 28, to provide for active air removal before and/or during pre-compaction under air pressure. The respective ducts and valves 28 are then connected to a suitable source of vacuum, not shown, and well known.

The next step in the operating cycle is shown in FIG. 7. The maximum difference in stroke between respective press plungers of at least 30%, related to the height of the pattern box or mold box, is maintained (see FIG. 2).

The fluidizing and pre-compaction effect obtained by the gas pulse is effective at least during the major portion of the stroke or movement of the compaction head 9 due to the high speed of the press plungers 7. The valves 25 can be suitably controlled, so that the duration of effective application of the gas pulse can be so matched to the remaining parameters of the process that optimum effects are obtained. The gas pulse, typically compressed air, can, under some conditions, be relatively weak, so that the sand is only fluidized without, however, being pre-compacted. Valves 25 can be controlled, for matching the other parameters, by the control unit 20, as schematically shown in FIG. 5.

The invention has been described in the various embodiments in connection with a compaction head 9 which is movable, and operated by the hydraulic piston or ram 13. Of course, rather than moving the compaction head 9, or the apparatus 6, it is equally possible to reverse the movement and hold the compaction head 9 stationary and rather move the pattern support plate 1, with the pattern against a fixed compaction head.

The system has the advantage that individual control of the respective press plungers 7, for example prebiassing of the press plungers 7, with the maximum difference in stroke between the press plungers 7 being at least 30%, and preferably 40% and more of the height H of the box 3, will result in such a high maximum stroke difference that even mold patterns with deep recesses can be molded with substantially homogeneous compaction of the foundry mold making material, and substantially better and more homogeneous than in the prior art. A typical mold pattern with a deep recess is shown in FIG. 1.

The present invention can also be used with mold forms which do not use a specific unitary mold frame but, rather, with mold forms in which the structure equivalent to the mold box can be disassembled or stripped off after molding and compaction. The invention can also be used in combination with other precompaction processes.

Various changes and modifications may be made, and features described in connection with any one of the embodiments may be used with any of the others, within the scope of the inventive concept.

The pre-setting of the press plungers 7 has been described in connection with application of fluid force against pistons operating in cylinders !0, for example compressed air, other compressed gases, or hydraulic pressure fluid. It is also possible to move the press plungers 7 in the selected positions by other mechanical means, for example by positioning motors presetting the respective press plungers 7 by connecting individual drive motors to spindles which retract or push downwardly the respective press plungers. Rather than using a direct spindle drive, and for protection of motors and gearing, springs can be interposed between the spindles and the plungers to provide for resilient, cushioned engagement of the plungers against the top surface of the molding sand.

We claim:

1. Method of compacting foundry molding material utilizing a molding machine, said molding machine having a mold box (3);

a mold pattern (2) in the mold box;

foundry molding material (5) surrounding the pattern and filling the mold box;

a pressure plate (8);

a plurality of press plungers (7), respective press plungers being located spaced from each other on the pressure plate in a predetermined pattern for penetration into the molding material in accordance with the shape of the mold pattern (2)

wherein the sum of the cross-sectional areas of the press plungers is between 20% to 70% of the cross-sectional area of the mold box (3); and pressure means (12) acting on the press plungers, said method comprising the steps of applying pressure by said pressure means (12) individually, to the press plungers (7) in accordance with the shape of the mold pattern (2) for compacting the molding material around the pattern in accordance with the shape of the pattern;

then applying the pressure plate (8) against the molding material for compacting the molding material, by moving the pressure plate to about the upper edge of the mold box (3); and wherein said step of applying pressure on the press plungers comprises applying said pressure at a level to generate, at the end of the step of compacting the molding material by the pressure plate, on at least one of the press plungers (7) a maximum difference ($\Delta H$) in level of penetration or stroke of movement between individual press plungers (7) which is at least 30% of the height (H) of the mold box (3).

2. The method of claim 1, wherein the press plungers (7), initially, solely apply compacting pressure or force against the molding material (5).

3. The method of claim 2, wherein said difference ($\Delta H$) in stroke or level of penetration is at least 40% of the height (H) of the mold box (3).

4. The method of claim 2, wherein said difference ($\Delta H$) in stroke or level of penetration is at least 50% of the height (H) of the mold box (3).

5. The method of claim 1, wherein the sum of the cross-sectional areas of the press plungers is between 20% to 50% of the cross-sectional area of the mold box (3).

6. The method of claim 1, wherein the sum of the cross-sectional areas of press plungers located in a central zone of the press plate has between 20% to 50% of the cross-sectional area of the mold box in alignment with said plungers;

and wherein the sum of the cross-sectional areas of the press-plungers adjacent marginal zones of the mold box is between 50% to 100% of the cross-sectional area in alignment with said plungers at the marginal areas.

7. The method of claim 1, wherein said step of applying the pressure means to the press plungers comprises applying fluid pressure to the press plungers (7) to move said press plungers;

and wherein the steps of moving said press plungers and of moving the pressure plate (8) are carried out to move the press plungers and the pressure plate towards the material (5) at a speed of over 2 m/s.

8. The method of claim 7, wherein said speed is between 3 to 10 m/s.

9. The method of claim 7, wherein said speed is between 4 to 8 m/s.

10. The method of claim 1, wherein said pattern (2) is spaced from the inner walls of the mold box, and said material is located in part between the mold box and said pattern;

and wherein said step of moving the pressure plate (8) and said plungers (7) includes applying the kinetic energy of the moving pressure plate and of the plungers, at the termination of the compaction stroke, at least primarily on said material (5) in the region adjacent the walls of the mold box.

11. The method of claim 1, wherein the step of applying the pressure means individually to the press plungers (7) comprises applying fluid pressure with individually discretely commanded pressure levels to the individual press plungers.

12. The method of claim 1, including the step of withdrawing the press plungers (7) prior to compaction from the pressure plate (8);

said step of applying pressure on the individual press plungers comprises applying fluid pressure at discretely controlled counter pressure levels to the press plungers to project the press plungers, in accordance with the shape of the pattern (2) from the pressure plate and to support said press plungers, in projected position, by fluid pressure of respectively different pressure levels, and said step of moving the pressure plate comprises moving the pressure plate (8) together with the press plungers (7) projecting therefrom, in accordance with the desired projection pattern, towards said material (5).

13. The method of claim 1, wherein said step of applying pressure means to the plunger comprises applying fluid pressure to the plungers;

and wherein said plungers are coupled to a pistoncylinder combination (10), said fluid pressure being applied to said cylinder-piston combination to provide a counter support for said plungers upon movement of said plungers in compacting direction, and holding said plungers to maintain said differences in stroke or level or penetration.

14. The method of claim 13, wherein the counterpressures in said piston-cylinder arrangements are essentially uniform, and the quantity of pressure fluid varies in respective plungers to provide said difference (Δ) in stroke or level of penetration.

15. The method of claim 14, wherein said pressure fluid is a hydraulic fluid, said plungers retaining, essentially, the relative projected positions and said differences in stroke or penetration level during compaction of said material (5).

16. The method of claim 1, in combination with the step of applying a compressed gas pulse to said material (5) at least during an initial portion of the step of moving the plungers (7) and the pressure plate for compacting said material in the mold box(3).

17. The method of claim 1, including the step of applying a compressed gas pulse to said material (5) at least in advance of the step of moving the plungers (7) and the pressure plate (8) for compacting said material (5) in the mold box (3).

18. The method of claim 17, including the step of removing gas, by suction, from said material in the mold box (3).

19. A molding machine for compacting foundry molding material having a mold box (3);

a mold pattern (2) in the mold box;

foundry molding mold material (5) surrounding the pattern and filling the mold box;

a pressure plate (8);

a plurality of press plungers (7), respective press plungers being located spaced from each other on the pressure plate in a predetermined pattern for penetration into the molding material in accordance with the shape of the mold pattern (2), wherein the sum of the cross-sectional areas of the press plungers is between 20% to 70% of the cross-sectional area of the mold box (3); and pressure means (12) acting on the press plungers, said machine comprising a plurality of pressure cylinders (10), one each coupled to a respective press plunger (7);

individual valve means (14, 15, $V_1$, $V_2$...$V_{Al}$, $_{VB}$...) interposed between at least those pressure cylinders which are located in a central region of the pressure plate and the fluid pressure means for individual control of penetration of the plungers into said molding material (5) in accordance with the shape of the mold pattern (2);

power means (13) coupled to said pressure plate (8, 308), to move the pressure plate in compacting direction toward said molding material (5) in the mold box (3); and control means (20) for controlling said valve means (14, 15, $V_1$, $V_2$...$V_A$, $V_B$...) and said power means (13) for sequentially applying fluid pressures to the respective press plungers (7) to engage the plungers with said molding material (5) and then engage the pressure plate (8, 308) with the molding material.

20. The machine of claim 19, wherein the pressure means comprises a manifold or pressure chamber (16);

and wherein said valve means includes pilot valves (15) individually permitting application of pressurized fluid from said plenum or chamber to a respective pressure cylinder (10).

21. The machine of claim 19, wherein the valve means comprises two groups of valves ($V_1$, $V_2$...$V_A$, $V_B$...) arranged in a row -and-column matrix, and the pressure means (12) include, respectively, pressurized supply lines and drain lines connected, respectively, to the valves of the rows and columns of the pressure cylinders to provide for individual control of pressure fluid upon control of said valves in the matrix configuration.

22. The machine of 19, wherein said control means is a programmable control means (20, 220, 320) coupled to said valve means for controlling at least one:

(a). the pressure;

(b). the quantity of pressure fluid being applied to said pressure cylinders.

23. The machine of claim 22, wherein said control means controls in discrete steps, (a). the application of pressure, (b). the quantity of pressure fluid.

24. The machine of claim 19, wherein the pressure Plate (8, 308) is formed with projecting extensions (**8*a*, 308*a*) located in the region between those press plungers (7) which are located at circumferential marginal portions of the pressure plate (8, 308) and the edge of the pressure plate, and extending towards the mold box (3**).

25. The machine of claim 24, wherein said extensions comprise a circumferential rim (**8*a***).

26. The machine of claim 24, wherein said extensions comprise individual projecting elements (**308*a***).

27. The machine of claim 24, wherein said extensions have a width of about 5 to 10 cm and a height of about 5 to 13 cm.

28. The machine of claim 24, including means (310, 311, 312) for movably supporting said extensions on the pressure plate to provide for controllable projection thereof from the pressure plate.

29. The machine of claim 28, wherein said means for projecting the extensions comprise pneumatic means (310, 311, 312).

30. The machine of claim 19, further including a pressure head (9), said pressure plate (8) and press plungers (7) and said pressure cylinders (10) being located within said pressure head (6, 9) and projectable therefrom for compaction of said molding material (5);

further including a pressure vessel (21) surrounding said compaction head and fitting tightly against said mold box (5).

31. The machine of claim 30, further including a valve (23) located on the compaction head (6, 9) for supplying fluid pressure from within the pressure vessel (21) to the interior of the compaction head.

32. The machine of claim 31, wherein said pressure vessel (21) includes two chambers (21*a*, 21*b*), said pressure head being located within one of said chambers, and formed with through-flow openings therein, and said valve (23) comprises a disk valve establishing fluid pressure communication between said two chambers.

33. The machine of claim 32, wherein the power means (13) move both said pressure plate (8, 308) and said press plungers (7) in compacting direction towards said mold box, said valve (23) being coupled to said power means (13) and being opened, simultaneously, upon movement of said pressure head by said power means.

34. The machine of claim 19, including a pressure head (6, 9) retaining said pressure plate (8, 308), said plurality of press plungers (7) and said pressure cylinders (10) coupled thereto;

said pressure head including a pressure chamber (9*a*) coupled to a compressed fluid source (24).

35. The machine of claim 34, wherein said pressure cylinders (10) are located within said pressure chamber (9*a*).

36. The machine of claim 34, wherein the pressure head (9) defines a head space region separate from said pressure chamber (9*a*);

and wherein at least one valve (25) is provided for communicating said pressure chamber (9*a*) with said head space region, said head space region being adapted to be coupled to the mold box (3).

37. The machine of claim 34, wherein said pressure head (9) is tightly engageable with said mold box (3).

38. The machine of claim 37, further including sealing means located on the engagement region between said pressure and said mold box (3) for sealing the pressure head and the mold box.

39. The machine of claim 30, further including suction ducts (28) communicating the region of the mold box retaining said pattern (2) to the outside of said mold box (3).

40. The machine of claim 19, wherein the sum of the cross-sectional areas of the press plungers is between 20% to 50% of the cross-sectional area of the mold box (3).

* * * * *